US006213799B1

(12) United States Patent
Jazowski et al.

(10) Patent No.: US 6,213,799 B1
(45) **Date of Patent: *Apr. 10, 2001**

(54) ANTI-FLASHOVER RING FOR A BUSHING INSERT

(75) Inventors: Roy E. Jazowski, Greeneville; Edward H. Decker, Rogersville, both of TN (US)

(73) Assignee: Hubbell Incorporated

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/085,801

(22) Filed: May 27, 1998

(51) Int. Cl.[7] ..... H01R 13/53
(52) U.S. Cl. ..... 439/181; 439/921; 439/181
(58) Field of Search ..... 439/205.6, 181, 439/186, 921, 923, 934

(56) References Cited

U.S. PATENT DOCUMENTS

| | | | | |
|---|---|---|---|---|
| 3,953,099 | | 4/1976 | Wilson . | |
| 4,260,214 | * | 4/1981 | Dorn | 439/181 |
| 4,793,637 | * | 12/1988 | Laipply et al. | 285/39 |
| 4,822,291 | * | 4/1989 | Cunningham | 439/187 |
| 4,867,687 | * | 9/1989 | Williams et al. | 439/10 |
| 4,972,049 | * | 11/1990 | Muench | 174/152 |
| 5,641,310 | | 6/1997 | Tiberio, Jr. . | |
| 5,795,180 | | 8/1998 | Siebens . | |
| 5,816,835 | * | 10/1998 | Meszaros | 439/205 |
| 5,857,862 | * | 1/1999 | Muench et al. | 439/181 |
| 5,957,712 | | 9/1999 | Stepniak . | |

OTHER PUBLICATIONS

Cooper Power Systems, *The Cooper Posi–Break Elbow Elbow and Cap* (1998) No Month.

* cited by examiner

*Primary Examiner*—Lincoln Donovan
(74) *Attorney, Agent, or Firm*—Mark S. Bicks; Alfred N. Goodman

(57) ABSTRACT

The anti-flashover ring of the present invention includes a substantially cylindrical body having an outer surface with a plurality of passageways thereon. Each of the passageways pass from one of the sidewalls through the body to the other of the sidewalls of the ring. The passageways function to provide fluid communication between the atmosphere surrounding an accessory product such as a bushing insert and the interior of a connector mounted thereon when the connector is being pulled off the bushing insert. The fluid communication prevents a vacuum from forming between the connector and the bushing insert that can lead to a flashover between an electrical probe in the connector and a ground shield of the bushing insert. The anti-flashover ring is also configured to provide an indication to the operator installing the connector of when the connector is fully installed on the bushing insert. Such indication is provided by providing the ring with a width that is equal to length of the lip of the connector when the connector is fully installed. As such, the operator installing the connector continues to push on the connector until the end of the lip aligns with the end of the ring.

34 Claims, 6 Drawing Sheets

ANTI-FLASHOVER RING FOR A BUSHING INSERT

TECHNICAL FIELD

This invention relates generally to a safety device for high voltage electrical equipment and, more particularly, to a device used on high voltage accessory products to reduce the risk of flashovers when a connector or insulated cap is removed from the accessory product. Specifically, the present invention relates to an anti-flashover ring that fits on an accessory product and prevents a flashover-promoting vacuum from forming between the accessory product and a connector as the connector is pulled off the accessory product.

BACKGROUND OF THE INVENTION

Safety is of paramount importance to line crew operators who deal with high voltage electrical equipment given the consequences of a mistake or an unfortunate occurrence. High voltage electrical equipment includes, but is not limited to, various sized bushing inserts, feed-through devices, multi-position junctions, and insulated or stand-off bushings. The foregoing equipment is usually held in a fixed position to receive mounting connectors such as appropriately sized elbow connectors, insulating caps and the like. Although interconnection between a particular type of accessory product and a connector is discussed herein, it will be appreciated that the existing problems and the solution is applicable to all accessory products and their connections.

One of the more dangerous tasks performed by an operator is disconnecting a live source of power by physically breaking a connection between the foregoing rather than throwing a switch. A risk in performing such a disconnect is that the electricity from the live end of the connection may arc or flashover to ground. Such a flashover can damage the equipment and may cause injury. For example, one such a flashover problem has been found to occur when elbow connectors are removed from bushing inserts.

A typical prior art bushing insert and elbow connector are depicted in FIGS. 1 and 2. The bushing insert is indicated generally by the numeral 10 while the cable or elbow connector is indicated generally by the numeral 12. Bushing insert 10 includes a body with semi-conductive shielded collar 14 that is substantially cylindrical but may be slightly tapered. A semi-conductive shielded sheath 16 extends from one end of collar 14. Sheath 16 and collar 14 provide protection and a ground shield for bushing insert 10. The body also includes a non-conductive frusto-conical portion 18 or first portion extends outwardly from the other end of collar 14 and terminates at an annular locking groove 20. A snuffer assembly 21 extends from frusto-conical portion 18. Snuffer assembly 21 is provided to protect the internal components of bushing insert 10. A shoulder wall or portion 22 forms the connection between collar 14 and frusto-conical portion 18. Shoulder wall 22 is disposed at a substantial right angle with respect to collar 14 and joins frusto-conical portion 18 in a small chamfer. Bushing insert 10 provides an inner bore with an internal electrical connection components or conductive component therethrough to provide a medium for electrically connecting elbow connector 12 to other electrical distribution equipment. A second portion extends from collar 14 for connection to an equipment bushing well.

Elbow connector 12 includes a bushing port 24 having an interior wall 26 that is configured to tightly conform to frusto-conical portion 18 of bushing insert 10. Bushing port 24 is thus configured to snugly engage bushing insert 10 when elbow connector 12 is locked on bushing insert 10. This position is depicted in FIG. 1. When elbow connector 12 is locked on bushing 10, a lip 28 of bushing port 24 is positioned over a portion of collar 14. Lip 28 includes a terminal wall or end 30 and an inner wall 32. Lip 28 joins with the body of bushing port 24 forming a shoulder 34 having an end wall 36. End wall 36 contacts shoulder wall 22 and inner wall 32 contacts collar 14 when elbow connector 12 is locked on bushing insert 10. Furthermore, interior wall 26 of elbow connector 12 snugly engages frusto-conical portion 18 of bushing insert 10 when elbow connector 12 is locked on bushing insert 10. Connecting elbow connector 12 to bushing insert 10 is enhanced by the presence of a high dielectric lubricant that may be used to provide a well lubricated fitting between bushing insert 10 and connector 12. An electrical probe 37, which is connected to an electrical cable, is concentrically disposed within bushing port 24 and extends into the electrical connection components within bushing insert 10.

The problem encountered with the connection between bushing insert 10 and connector 12 in the prior art is depicted in FIG. 2. FIG. 2 shows a position of connector 12 as it is removed from bushing insert 10. In this position, bushing port 24 and lip 28 have moved slightly off of bushing insert 10 forming gaps 38 between end wall 36 and shoulder wall 22 as well as between frusto-conical portion 18 and interior wall 26. Gaps 38 form vacuums or partial vacuums given the tight connection between lip 28 and collar 14 as well as between bushing port 24 and frusto-conical portion 18. Testing has revealed that an especially large vacuum occurs between end wall 36 and shoulder wall 22 as connector 12 is removed from bushing insert 10. The existence of lubricant on these elements also aids the formation of a vacuum in gaps 38. The existence of a vacuum or partial vacuum in gaps 38 increases the likelihood of a flash-over between electrical probe 37 and the shielded collar 14 over the insulated frusto-conical portion 18. This flashover or electrical arc will damage bushing insert 10 and connector 12, requiring their replacement.

It is thus desired in the art to provide a device that prevents the vacuums from forming between bushing insert 10 and connector 12 while connector 12 is removed from bushing insert 10. Such a device ideally would be able to be retrofit onto existing bushing inserts such that the entire bushing insert would not have to be replaced to provide this benefit. Furthermore, the desired device could be easily manufactured to fit a wide variety of rated bushing inserts, junctions and other similar accessory products.

Another safety problem with bushing inserts and connectors is that the operator installing the connector on the insert does not always know when the connector is fully attached to and locked on the bushing insert. Although an experienced operator may develop a feel for a secure and locked connection between the two elements, the inexperienced operator who infrequently connects the items desires an indicator that tells them when the two elements are fully locked together. It is thus desired in the art to provide a device that gives an indication to the operator of when the connector is fully installed on the bushing insert. Such a device should ideally be able to be manufactured to fit a wide variety of bushing insert sizes and accessory products and be capable of being retrofit onto existing bushing inserts.

SUMMARY OF INVENTION

In light of the foregoing, it is a first aspect of the present invention to provide a device that prevents flashover between high voltage accessory products and a mating connector as they are separated from one another.

Another aspect of the present invention is to provide an anti-flashover device that prevents a vacuum from forming between an accessory product such as a bushing insert and a mating connector as the connector is removed from the bushing insert.

Yet another aspect of the present invention is to provide an anti-flashover device that may be retrofit onto existing bushing inserts and the like.

Still another aspect of the present invention is to provide an anti-flashover device that may be manufactured to fit a wide variety of differently sized bushing inserts and other accessory products.

A further aspect of the present invention is to provide an anti-flashover device that functions as an indicator for telling an operator installing the connector on the bushing insert when a complete locked connection between the connector and the bushing insert is achieved.

Still a further aspect of the present invention is to provide a device that provides a visual indication of when a locked connection between the bushing insert and the connector is achieved.

An additional aspect of the present invention is to provide an anti-flashover device that is of simple construction, which achieves these stated objectives and aspects of the invention in a simple, effective, and inexpensive manner, and which solves the problems and which satisfies the needs existing in the art.

The foregoing and other aspects of the present invention, which shall be come apparent as the detailed description proceeds, are achieved by an anti-flashover ring for a bushing insert, comprising a ring-shaped body having an inner surface and an outer surface and at least one passageway extending entirely through the body to provide a fluid path through the body, wherein the ring-shaped body is disposed over the bushing insert.

Other aspects of the present invention are obtained in combination, a bushing insert and an anti-flashover ring, the combination comprising a bushing insert having a collar extending from a frusto-conical portion, an anti-flashover ring having a ring-shaped body having an inner surface and an outer surface, the body carried on the bushing insert, the ring having at least one fluid passageway, at least one fluid passageway providing a fluid path through the body.

Still other aspects of the present invention are obtained in combination, a bushing insert, a connector, and an indicator ring, the combination comprising a bushing insert including a collar and a frusto-conical portion with a shoulder connecting the collar to the frusto-conical portion, a connector having a bushing port and a lip extending from one end of the bushing port, the lip having a terminal wall, and an indicator ring being carried on the bushing insert in contact with the shoulder, the ring having a first sidewall and a second sidewall, the ring being positioned between the bushing insert and the connector when the connector is fully installed on the bushing insert, the terminal wall of the skirt being aligned with the second sidewall of the indicator ring when the connector is fully installed on the bushing insert.

Yet other objectives of the invention are achieved by a method for installing a connector on a bushing insert having a shoulder formed between a collar and a frusto-conical portion comprising the steps of placing a ring on the shoulder formed between the collar and the frusto-conical portion of the bushing insert, the ring having a body with a first sidewall and a second sidewall, placing the connector over the bushing insert and moving the connector over the bushing insert until the connector contacts the ring, and continuing to move the connector over the ring until the terminal end of the connector aligns with the second sidewall of the ring.

BRIEF DESCRIPTION OF THE DRAWINGS

For a complete understanding of the objects, techniques, and structure of the invention, reference should be made to the following detailed description and accompanying drawings wherein.

Similar numbers refer to similar elements throughout the specification.

PREFERRED EMBODIMENT FOR CARRYING OUT THE INVENTION

Figure 1:
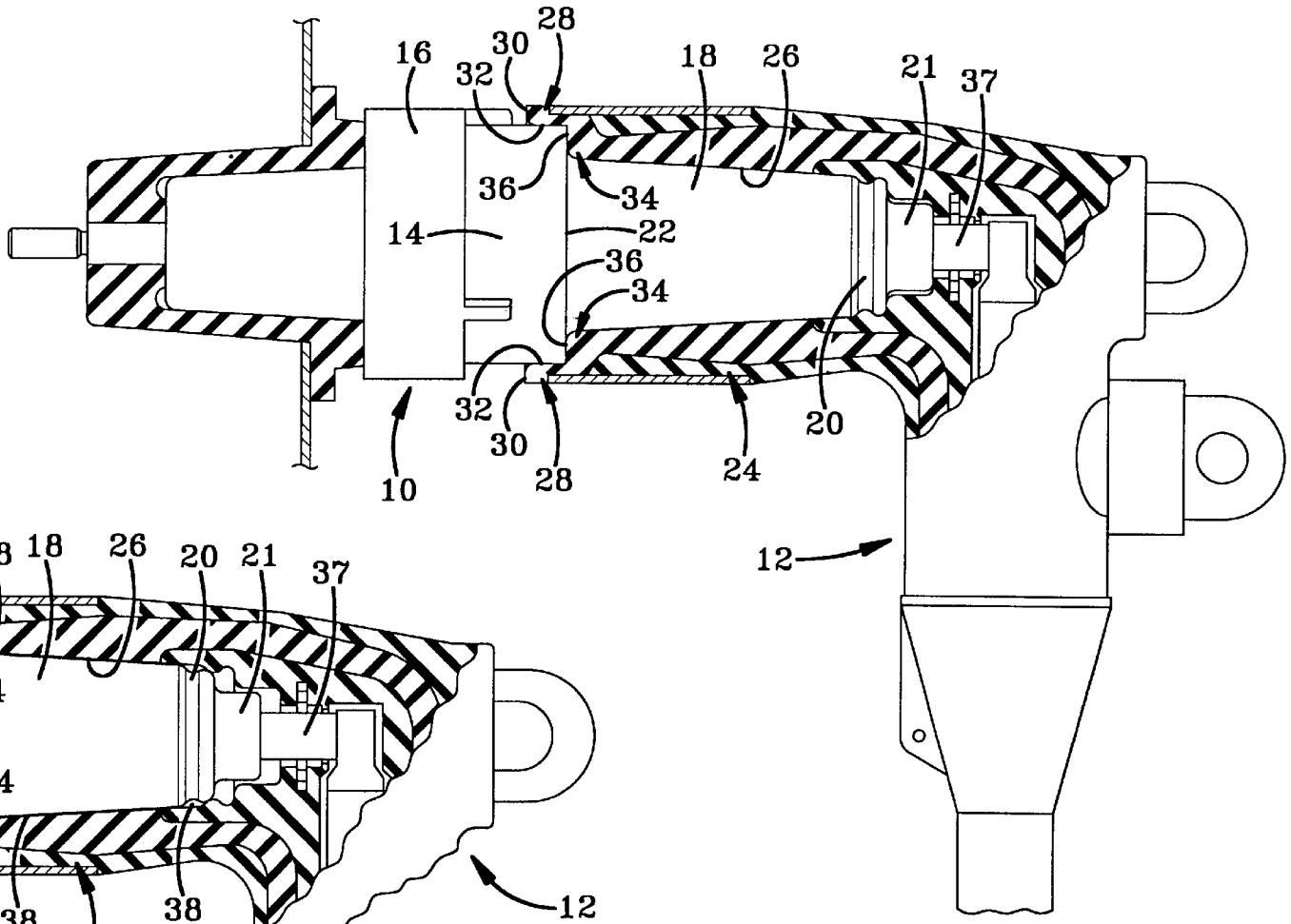
FIG-1 PRIOR ART
FIG. 1 is a side view, partially in section, of a prior art connection between a bushing insert and a connector.
Figure 2:
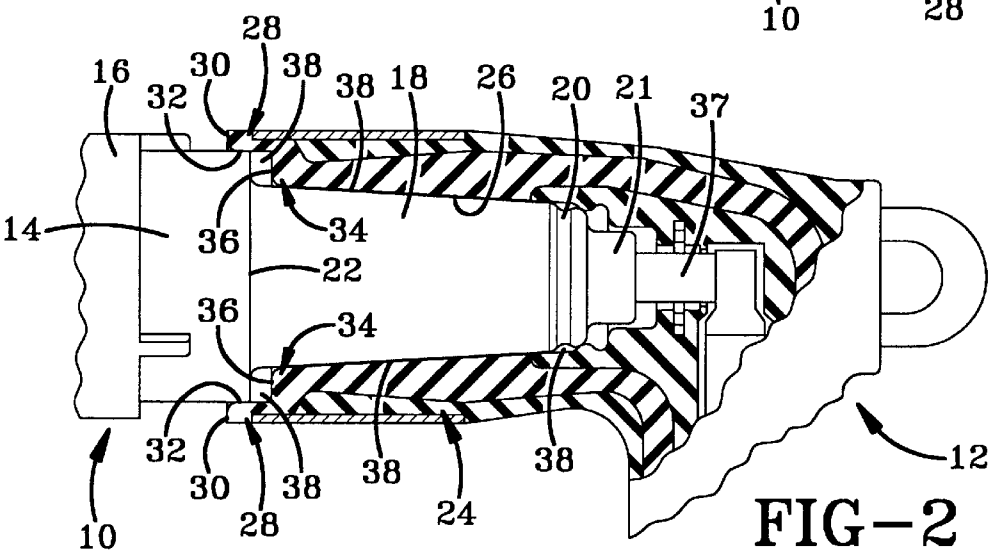
FIG-2 PRIOR ART
FIG. 2 is a side view, partially in section, of a prior art connector being removed from a bushing insert.
Figure 3:
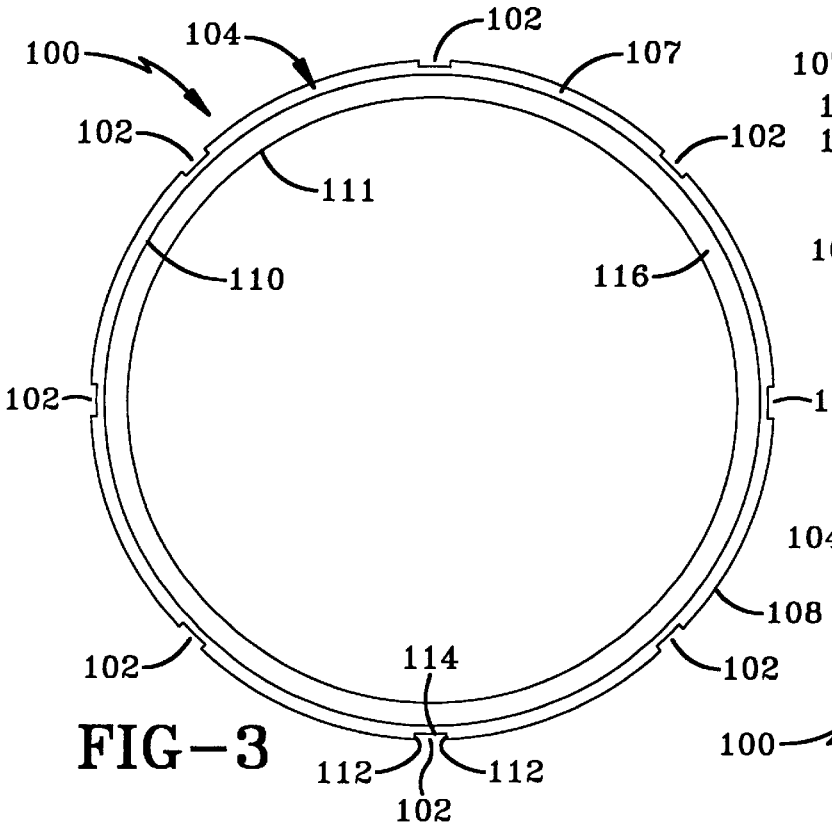
FIG. 3 is a rear elevational view of the anti-flashover ring of the present invention.
Figure 4:
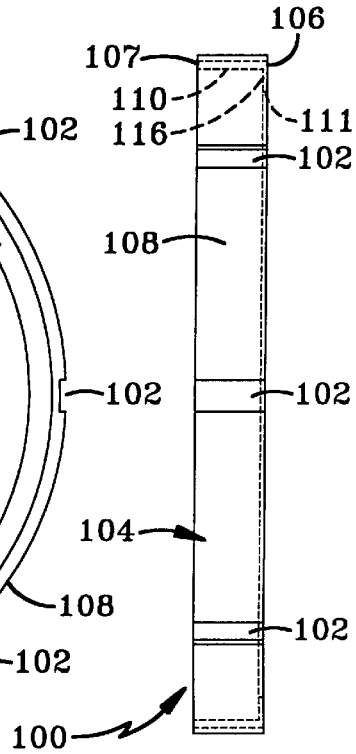
FIG. 4 is a side elevational view of the anti-flashover ring of the present invention.

Referring now to the drawings, and more particularly FIGS. 3–10, it can be seen that an anti-flashover ring according to the present invention is designated generally by the numeral 100. Ring 100 is generally circular in shape and may be fabricated from a non-conductive material such as a thermoplastic elastomer. Whatever material is used, it is likely expandable to fit over various sized bushing inserts. Other suitable polymeric materials are also contemplated by the present invention. Ring 100 includes at least one fluid passageway or notch, each indicated generally by the numeral 102, that functions to prevent a vacuum from being formed between connector 12 and bushing insert 10 when separated from each other with ring 100 properly positioned on bushing insert 10. As used herein, fluid is defined as a liquid or gas, such as air, that tends to flow or conform to the outline of its container.

Ring 100 includes a ring-shaped body 104 that has an outer surface 108 and at least one inner surface 110. Each fluid passageway 102 extends transversely along outer surface 108 to provide a fluid path through body 104. In the preferred embodiment of the present invention, each fluid passageway 102 extends in a longitudinal direction through body 104. The longitudinal direction being substantially perpendicular to all of the radii of body 104. In other words, passageways 102 are radially disposed around the outer periphery of body 104. Fluid passageways 102 may be in the form of the notches as depicted in the drawings or may be channels interior to body 104. Fluid passageways 102 may further be disposed along inner surface 110.

In the preferred embodiment of the invention depicted in the accompanying drawings, body 104 includes a pair of opposed side walls or first and second axial ends 106 and 107, an outer surface 108, and an inner surface 110. Passageways 102 are formed in body 104 and are open to outer surface 108 and extend from one sidewall 106 or 107 through body 104 to the other side wall 107 or 106. Each passageway 102 includes substantially parallel sidewalls 112 that are connected to a bottom wall 114 that is substantially perpendicular to each side wall 112. In other embodiments of the present invention, each side wall 112 may be radially disposed relative a central axis of body 104 with bottom wall 114 being concentric with outer surface 108. In still other embodiments of the present invention, passageways 102 may be rounded, triangular, or have other cross sections that provide a distinct fluid path through body 104 from one side wall 106 or 107 to the other side wall 107 or 106. In any of these configurations, the dimensions of each notch 102 must be sufficient to provide a substantial fluid path through body 104 when body 104 is disposed between bushing insert 10 and connector 12. As such, the dimensions of each notch 102 must be sized such that connector 12 does not fill notches 102 and choke off the fluid path.

Passageways 102 may be evenly distributed about body 104 or may be randomly disbursed. In the preferred embodiment of the present invention, eight notches 102 are evenly distributed about body 104 about every 45 degrees. Other configurations are, of course, contemplated by the present invention. Ring 100 may be fabricated to fit a wide variety of bushing inserts 10 simply by changing its dimensions. The drawings presented herein show a 25 kV bushing insert. The aspects of the present invention are also applicable to 15 kV and 35 kV rated bushing inserts and other accessory products. Another advantage of ring 100 is that an existing bushing insert 10 can be easily retrofit with anti-flashover ring 100 without tools or extensive downtime.

Body 104 further includes a shoulder that is formed by a shoulder wall 116 that extends radially inwardly from inner surface 110. Shoulder wall 116 is connected to sidewall 106 by inner surface 110. The shoulder formed between inner surface 110 and shoulder wall 116 allows ring 100 to be easily positioned on collar 14 of bushing insert 10.

Figure 6:
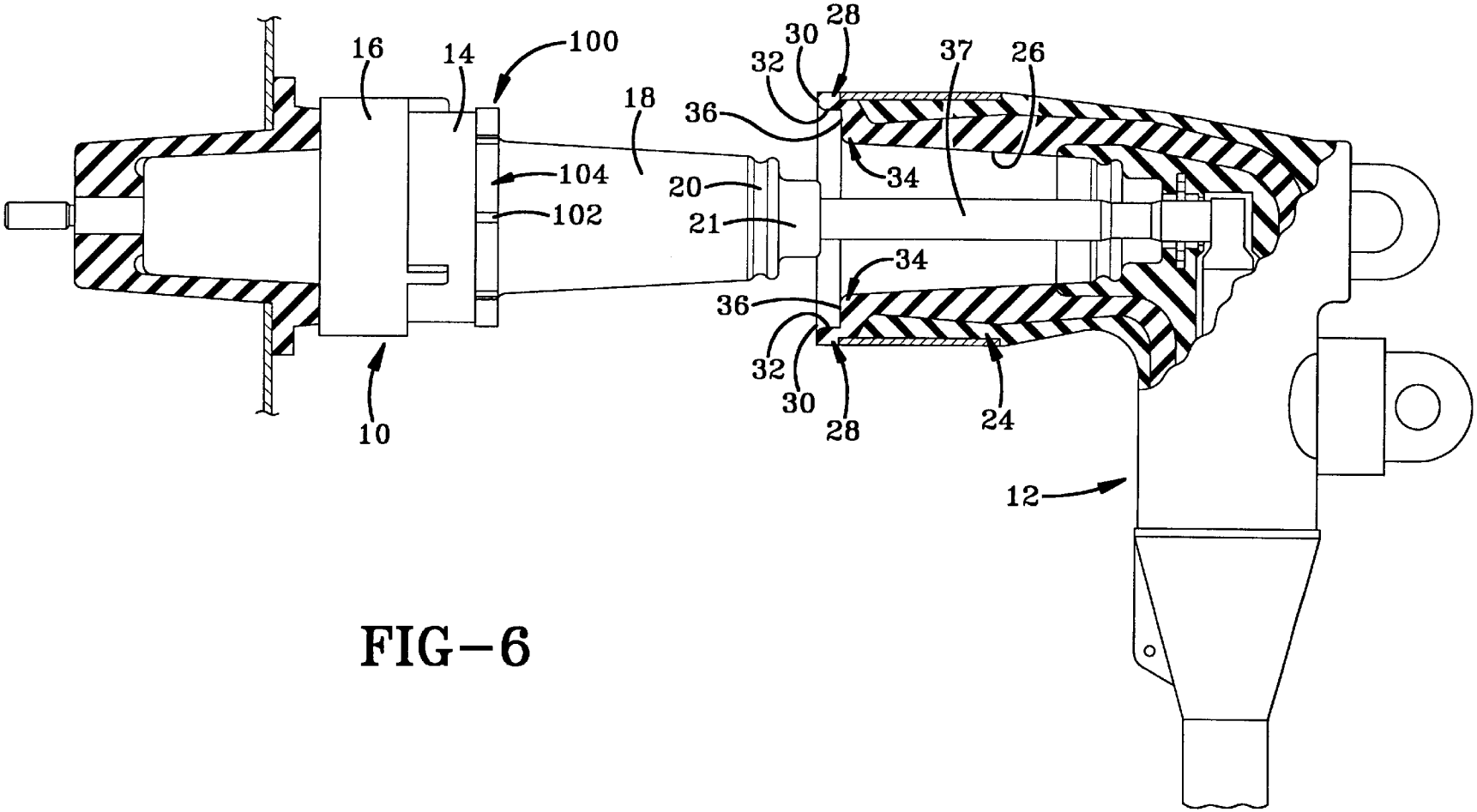
FIG. 6 is a side view, partially in section, of a prior art bushing insert carrying the anti-flashover ring of the present invention and a prior art connector being positioned such that it can be installed on the bushing insert.

Anti-flashover ring 100 is depicted as being positioned on a prior art bushing insert 10 in FIG. 6. Ring 100 is carried on collar 14 of bushing insert 10 such that shoulder wall 116 of ring 100 abuts shoulder wall 22 of collar 14. The engagement between shoulder walls 116 and 22 as well as the fact that inner wall 110 has a diameter that is substantially the same as the outer diameter of collar 14 provides a secure frictional engagement between ring 100 and collar 14. The shoulder-to-shoulder contact also prevents ring 100 from moving when connector 12 is installed.

Figure 5:
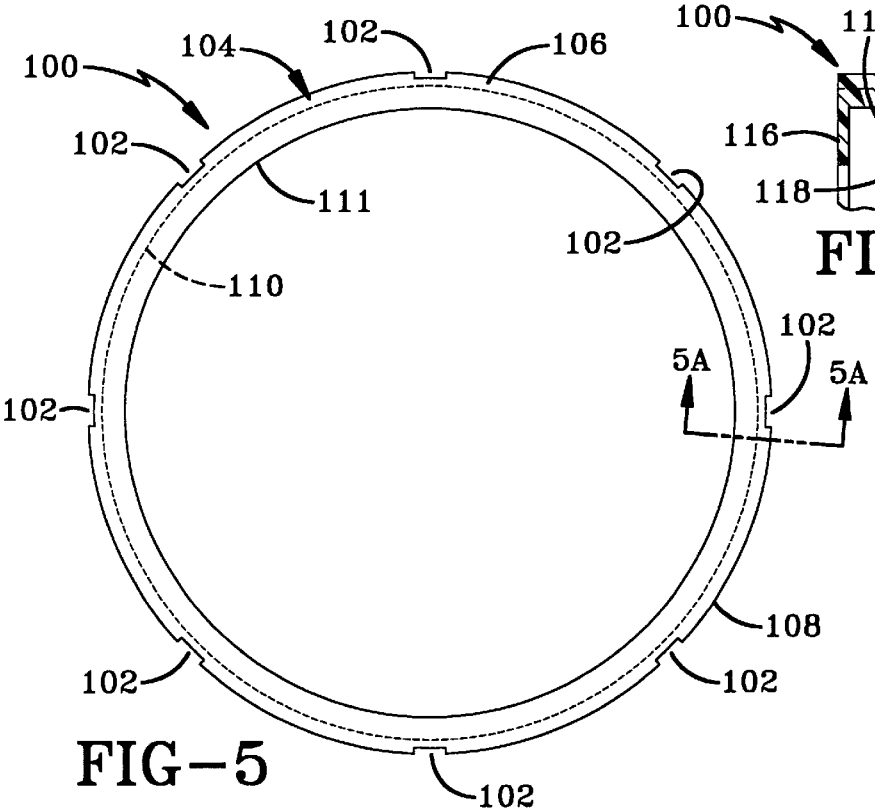
FIG. 5 is a front elevational view of the anti-flashover ring of the present invention.
Figure 5A:
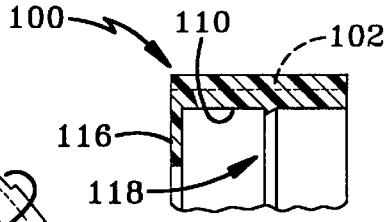
FIG. 5A is a partial cross-sectional view taken along line 5A—5A of FIG. 5.

As seen in FIG. 5A, an interior ring or barbed feet 118 may extend angularly from inner surface 110 in the same direction as shoulder wall 116. The ring or feet 118 function to grip the shoulder wall 22 and prevent rotational movement when the ring 100 is installed.

Figure 7:
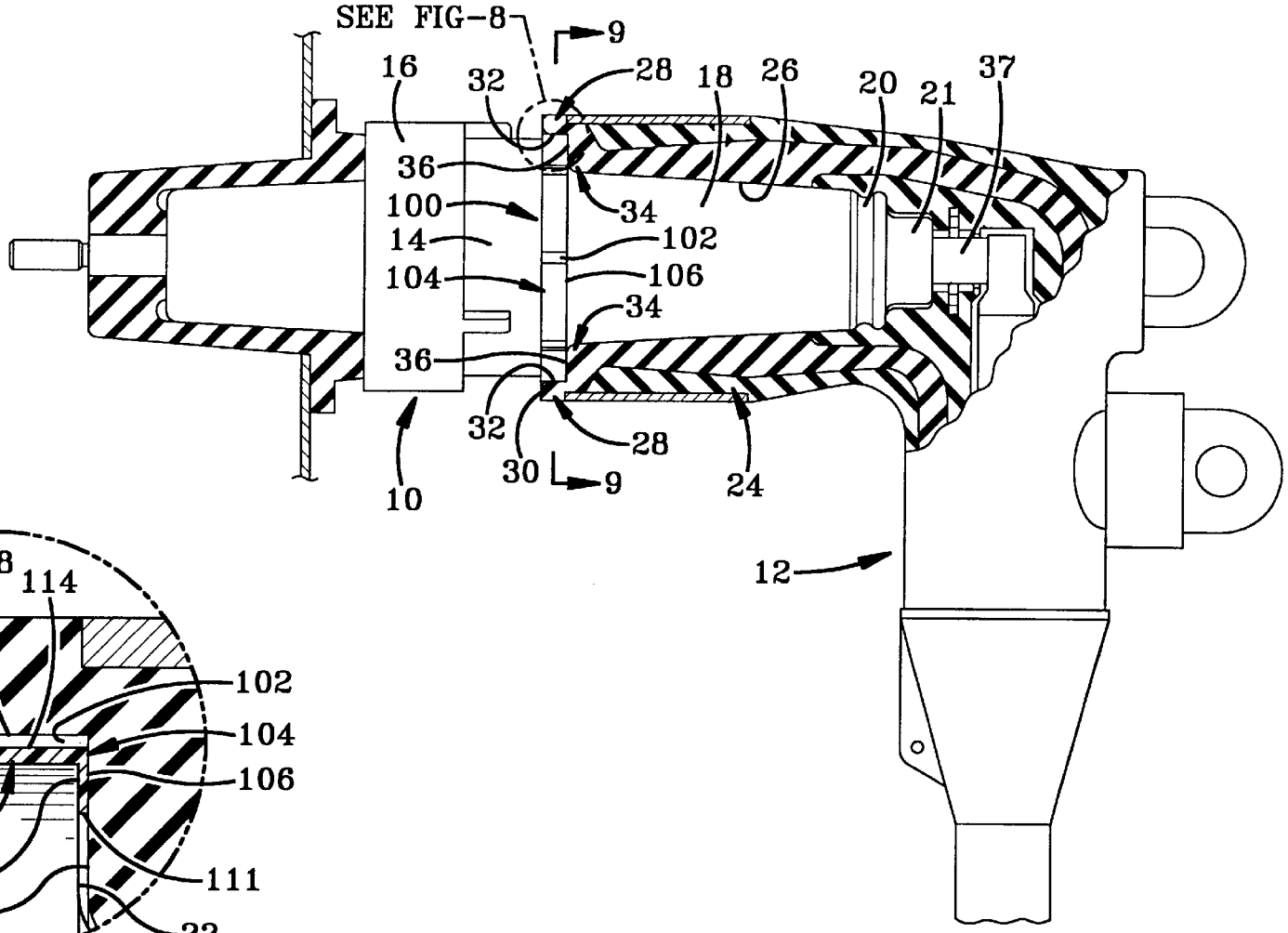
FIG. 7 is a side view, partially in section, of a prior art connector locked onto a prior art bushing insert utilizing the anti-flashover ring of the present invention.

As seen in FIG. 7, connector 12 is positioned on bushing insert 10 in the same way as it is connected to bushing insert 10 in the prior art. When ring 100 is installed on bushing insert 10, lip 28 of bushing port 24 of connector 12 flexes and slides over ring 100 when connector 12 is fully installed and locked on bushing insert 10. In this position, end wall 36 of bushing port 24 abuts side wall 106 of ring 100. Furthermore, inner wall 32 of lip 28 slides over and contacts outer surface 108 of ring 100. It may also be seen that terminal wall 30 of bushing port 24 is substantially aligned and flush with side wall 107 of ring 100.

Figure 8:
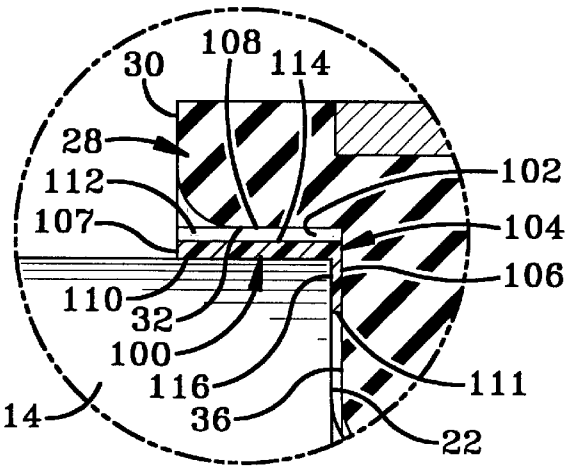
FIG. 8 is an enlarged sectional view of the anti-flashover ring of the present invention installed between the prior art bushing insert and the prior art connector.
Figure 9:
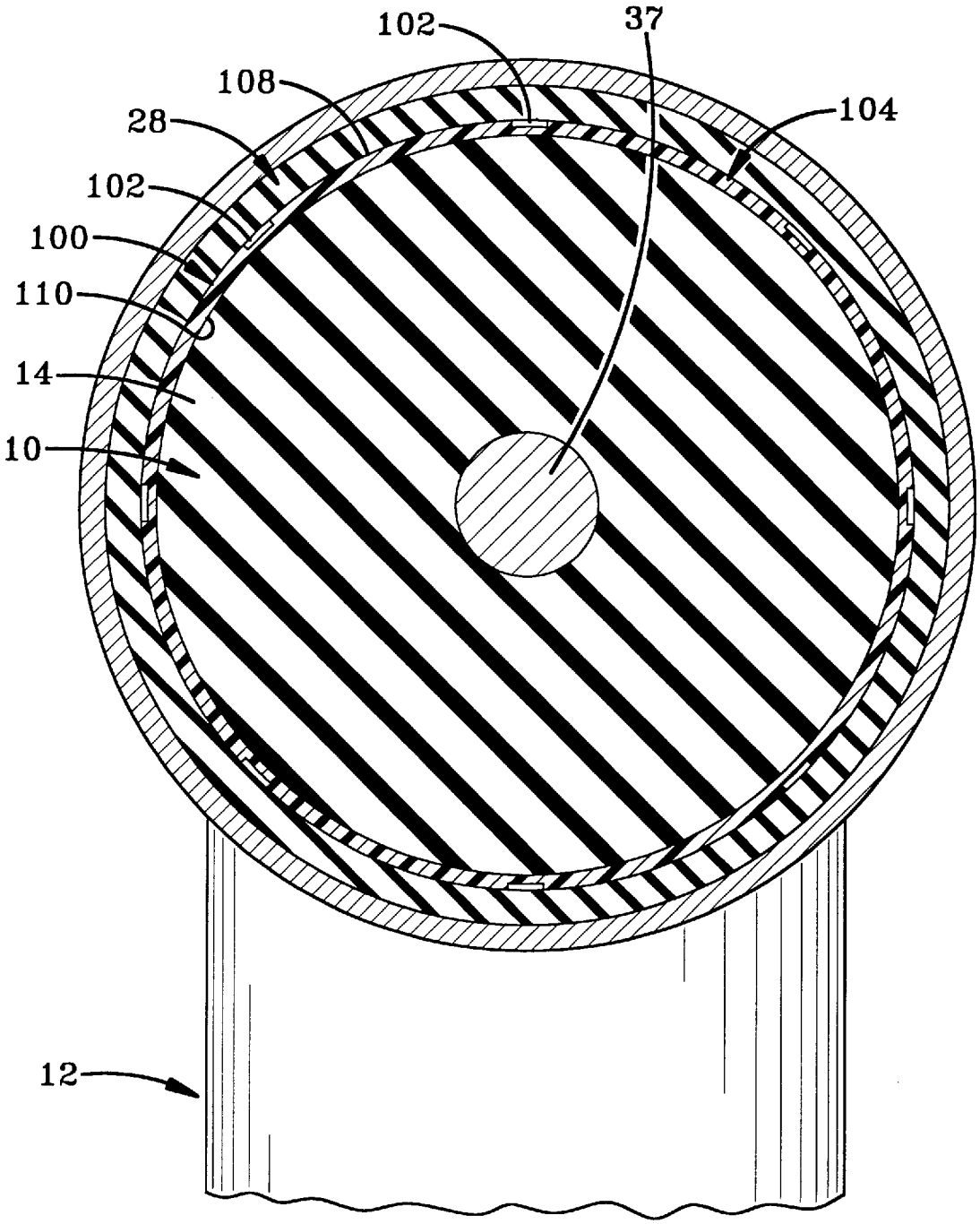
FIG. 9 is a sectional view taken along line 9—9 of FIG. 7.
Figure 10:
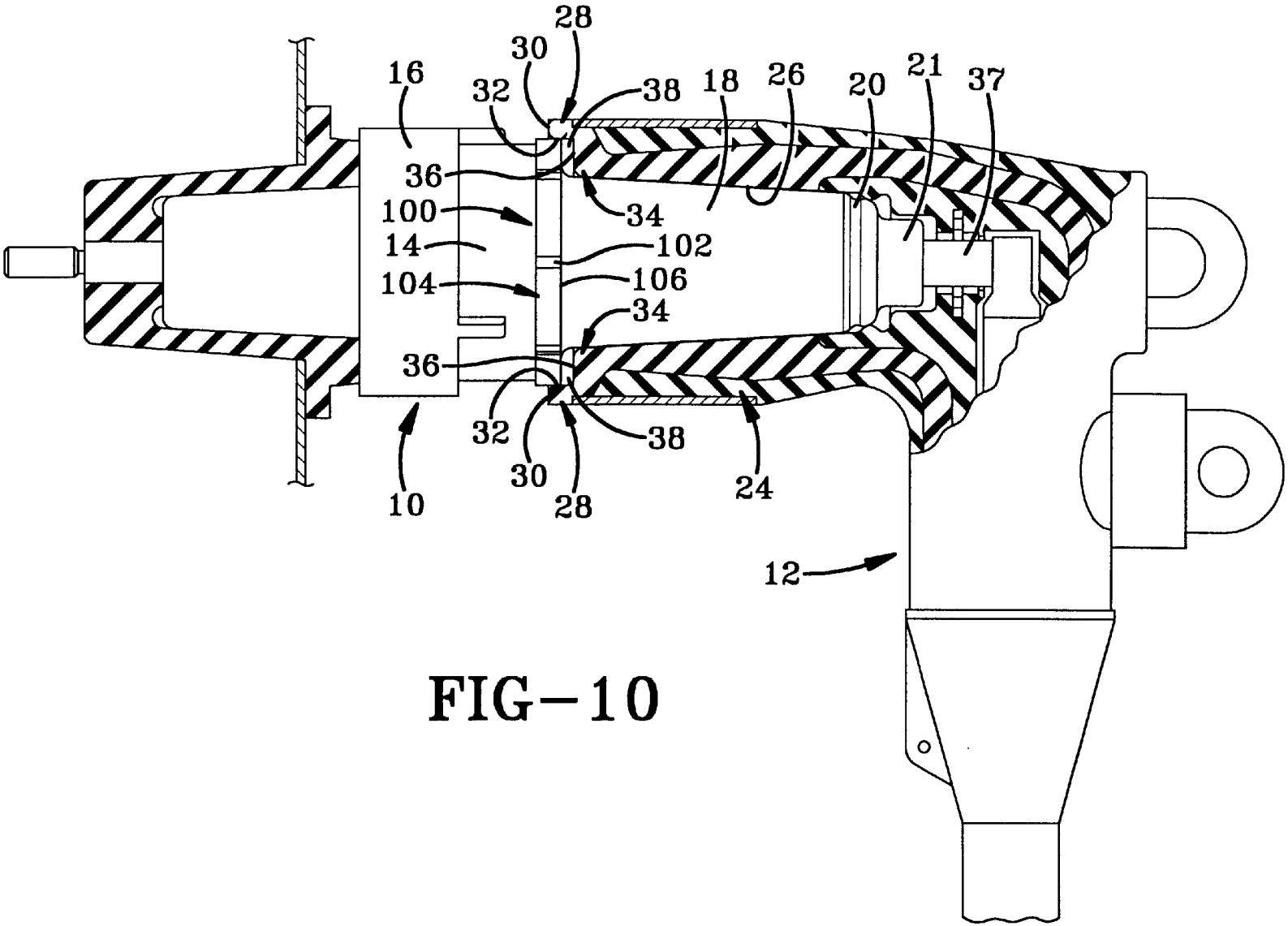
FIG. 10 is a side view, partially in section, of the prior art connector being removed from the prior art bushing insert carrying the anti-flashover ring of the present invention.

The advantage of providing ring 100 may be particularly seen in FIGS. 8–10 where it may be seen that passageways 102 provides continuous fluid communication from the relative a central axis of atmosphere surrounding bushing insert 10 and connector 12 through ring 100 into the interior of bushing port 24. Such fluid communication is especially important when connector 12 is removed from bushing insert 10 as depicted in FIG. 10. As connector 12 is pulled from bushing insert 10, passageways 102 allow the air surrounding bushing insert 10 to flow through ring 100 into the cavities or gaps 38 created as connector 12 is removed from bushing insert 10. It will be appreciated that with ring 100 installed upon collar 14, creation of a vacuum as connector 12 is removed from bushing insert 10 is virtually eliminated. Use of ring 100 creates a gap or opening, at atmospheric pressure, that extends from around probe 37 and locking groove 20, along the length of frusto-conical portion 18 and interior wall 26 to passageways 102. Such fluid communication prevents undesirable vacuums from forming, thereby decreasing the risk of arcing or flashover between electrical probe 37 and the shielded collar 14 and the shielded sheath 16. It may thus be seen that ring 100 achieves one of the primary objectives of the present invention by providing such fluid communication between accessory products and their mating connectors.

Ring 100 is also configured to provide a visual indicator to the operator that connector 12 is fully installed and locked on bushing insert 10. Ring 100 provides this function by being configured to correspond with the length of lip 28 of bushing port 24. As such, the width of ring 100 is substantially equal to the depth of lip 28 such that ring 100 disappears from view and covered when lip 28 completely covers ring 100 and connector 12 is fully installed on bushing insert 10. The operator installing connector 12 thus knows that a full or locked connection is achieved when ring 100 is completely hidden by lip 28. In order to increase the appearance of ring 100 against collar 14, ring 100 may be fabricated from a highly visible light reflective material that has a bright color or may be colored with a bright color after manufacture. For instance, ring 100 may be bright yellow in color.

This configuration allows the user to place connector 12 over the end of bushing insert 10 and push connector 12 toward collar 14 until lip 28 initially contacts ring 100. The operator installing connector 12 then continues to move connector 12 toward bushing insert 10 using substantial force until lip 28 fully covers ring 100. Once ring 100 has disappeared from view, the operator installing connector 12 stops pushing connector 12 toward bushing insert 10 knowing that the connection is secure.

Accordingly, the anti-flashover ring for a bushing insert or like accessory product is simple, provides an effective, safe, inexpensive, and efficient device that achieves all of the enumerated objectives of the invention, provides for eliminating difficulties encountered with prior devices, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the anti-flashover ring is constructed and used, the characteristics of the construction, and the advantageous new and useful results obtained; the new and useful structures, devices, elements, arrangements, parts, and combinations are set forth in the appended claims.

What is claimed is:

1. A method for mating a bushing insert and a cable connector, said bushing insert having first and second portions and a shoulder portion linking said first and second portions, said cable connector having a bushing port with a lip with a terminal end, comprising the steps of:

placing a ring on the shoulder portion of the bushing insert, the ring having a body with first and second axial ends;

inserting the bushing insert into the bushing port of the cable connector and moving the cable connector over the bushing insert until the lip of the bushing port covers the ring; and continuing to move the cable connector over the ring until the terminal end of the lip aligns with the second end of the ring;

further comprising the step of:

providing the ring with a plurality of passageways around an outer periphery thereof, each of said plurailty of passageways defines a gap between the bushing portion of the cable connector and the bushing insert; and removing the bushing insert from the bushing port of the cable connector allowing air to flow from the bushing port through the gaps to an outer atmosphere surrounding said bushing insert and said cable connector thereby preventing the reduction in pressure between the bushing insert and the bushing port.

2. An anti-flashover ring for facilitating the mating of a bushing insert and a cable connector, comprising:

a ring-shaped body having inner and outer surfaces and first and second axial ends;

a shoulder wall extending radially inward from said inner surface; and a passageway extending along said outer surface and radially into said ring-shaped body;

whereby said passageway provides fluid communication between an outer atmosphere surrounding the bushing insert and the cable connector, when the anti-flashover ring is disposed on the bushing insert and when the bushing insert with the anti-flashover ring are mated with the cable connector.

3. An anti-flashover ring for facilitating the mating of a bushing insert and a cable connector, comprising:

a ring-shaped body having inner and outer surfaces and first and second axial ends;

a shoulder wall extending radially inward from said inner surface; and a passageway extending along said outer surface and radially into said ring-shaped body;

whereby said passageway provides fluid communication between an outer atmosphere surrounding the bushing insert and the cable connector, and the cable connector when the anti-flashover ring is disposed on the bushing insert and when the bushing insert with the anti-flashover ring are mated with the cable connector.

4. An anti-flashover ring according to claim 3 wherein said passageway extends from said first axial end to said second axial end.

5. An anti-flashover ring according to claim 3 wherein said passageway has a pair of sidewalls connected by a bottom wall that forms part of said outer surface of said ring-shaped body.

6. An anti-flashover ring according to claim 5 wherein said ring-shaped body has a central axis;

said pair of sidewalls are radially disposed relative to said central axis of said ring-shaped body; and said bottom wall is concentric with said ring-shaped body.

7. An anti-flashover ring according to claim 3 wherein said ring-shaped body has a plurality of passageways.

8. An anti-flashover ring according to claim 7 wherein said plurality of passageways are evenly dispersed about said ring-shaped body.

9. An anti-flashover ring according to claim 3 wherein said outer surface of said ring-shaped body has a color, said color is bright for indicating whether the bushing inserted is completely mated with the cable connector.

10. An anti-flashover ring according to claim 3 wherein said ring-shaped body includes a means for engaging the bushing insert.

11. An anti-flashover ring according to claim 10 wherein said means for engaging includes gripping feet extending from said inner surface of said ring-shaped body.

12. An anti-flashover ring according to claim 3 wherein said anti-flashover ring is fabricated from a thermoplastic elastomer.

13. An electrical connector, comprising:

a bushing insert having a non-conductive body with an inner bore, a conductive component disposed within said inner bore, a first portion, a second portion, and a shoulder portion linking said first and second portions;

an anti-flashover ring separably formed from said bushing insert and disposed on said shoulder portion having a ring-shaped body portion with an inner surface and an outer surface, first and second axial ends extending between said inner and outer surfaces, a shoulder wall extending radially from said inner surface, said shoulder wall abutting said shoulder portion of said non-conductive body, and a first passageway disposed along said outer surface and radially into said ring-shaped body portion; and a cable connector having a bushing port receiving said first portion and said shoulder portion of said bushing insert, said conductive component being electrically connected to said cable connector, said anti-flashover ring being disposed between said shoulder portion and said bushing port, and said first passageway of said anti-flashover ring providing fluid communication between an outer atmosphere surrounding said busing insert and said cable connector, and the bushing port.

14. An electrical connector according to claim 13 wherein said first portion of said bushing insert has a frusto-conical shape forming a close fit with said bushing port; and said second portion is received in an equipment bushing well of equipment.

15. An electrical connector according to claim 13 wherein said ring-shaped body includes first and second axial ends extending between said inner and outer surfaces, said first passageway extending from said first axial end to said second axial end.

16. An electrical connector according to claim 13 wherein said first passageway has a pair of sidewalls connected by a bottom wall.

17. An electrical connector according to claim 16 wherein said ring-shaped body has a central axis;

said pair of sidewalls are radially disposed relative to said central axis of said ring-shaped body; and said bottom wall is concentric with said ring-shaped body.

18. An electrical connector according to claim 13 wherein said anti-flashover ring includes second and third passageways.

19. An electrical connector according to claim 18 wherein said first, second, and third passageways are evenly dispersed.

20. An electrical connector according to claim 13 wherein said bushing port includes a lip extending therefrom which covers said anti-flashover ring upon mating said bushing insert and said cable connector.

21. An electrical connector according to claim 20 wherein said lip of said bushing port includes a terminal wall, said terminal wall is aligned and flush with said second end of said anti-flashover ring when said bushing insert is fully mated with said cable connector.

22. An electrical connector according to claim 21 wherein said first passageway of said anti-flashover ring is open to said outer atmosphere when said bushing insert is fully mated with said cable connector.

23. An electrical connector according to claim 22 wherein said means for engaging includes gripping feet extending from said inner surface of said ring-shaped body.

24. An electrical connector according to claim 13 wherein said means for engaging includes gripping feet extending from said inner surface of said ring-shaped body.

25. An electrical connector according to claim 13 wherein said cable connector is an elbow connector.

26. An electrical connector, comprising:

a bushing insert having a non-conductive body with an inner bore, a conductive component disposed within said inner bore, a first portion, a second portion, and a shoulder portion linking said first and second portions;

an anti-flashover ring disposed on said bushing insert having a ring-shaped body portion with an inner surface and an outer surface, first and second axial ends extending between said inner and outer surfaces, and a first passageway disposed along said outer surface and radially into said ring-shaped body portion and extending from said first axial end to said second axial end; and a cable connector having a bushing port receiving said first portion and said shoulder portion of said bushing insert, and said anti-flashover ring, said bushing port having a lip with a terminal wall, said terminal wall being aligned and flush with said second axial end of said anti-flashover ring when said bushing insert is fully mated with said cable connector leaving said first passageway open to an outer atmosphere surrounding said bushing insert and said cable connector.

27. An electrical connector according to claim 26 wherein said anti-flashover ring is disposed on said shoulder portion of said bushing insert, said anti-flashover ring being located between said shoulder portion and said bushing port when said bushing insert is mated with said cable connector.

28. An electrical connector according to claim 26 wherein said conductive component is electrically connected to said cable connector when said bushing insert is mated with said busing port.

29. An electrical connector according to claim 26 wherein said first passageway provides continuous fluid communication between said bushing port and said outer atmosphere when both connecting and disconnecting said bushing insert and said bushing port of said cable connector preventing the reduction of pressure therebetween.

30. An electrical connector according to claim 26 wherein said anti-flashover ring includes a shoulder wall extending radially inward from said inner surface of said ring-shaped body, said shoulder wall abutting said shoulder portion of said bushing insert.

31. An electrical connector according to claim 26 wherein said anti-flashover ring is separable from said bushing insert.

32. An electrical connector according to claim 26 wherein said anti-flashover ring includes a second passageway.

33. An electrical connector according to claim 26 wherein said cable connector is an elbow connector.

34. The method according to claim 24 wherein the gaps provide continuous fluid communication between said outer atmosphere and the bushing port.

* * * * *

UNITED STATES PATENT AND TRADEMARK OFFICE

CERTIFICATE OF CORRECTION

PATENT NO. : 6,213,799 B1
DATED : April 10, 2001
INVENTOR(S) : Roy E. Jazowski et al.

It is certified that error appears in the above-identified patent and that said Letters Patent is hereby corrected as shown below:

Column 7, lines 45 through 67 and Column 8, lines 1-6,
Claims 2 and 3, should be deleted, and substitute therefor claims 2 and 3, as follows:

--- 2. The method according to claim 1 wherein the gaps provide continuous fluid communication between said outer atmosphere and the bushing port.

3. An anti-flashover ring for facilitating the mating of a bushing insert and a cable connector, comprising:
a ring-shaped body having inner and outer surfaces and first and second axial ends;
a shoulder wall extending radially inward from said inner surface; and
a passageway extending along said outer surface and radially into said ring-shaped body;
whereby said passageway provides fluid communication between an outer atmosphere surrounding the bushing insert and the cable connector, when the anti-flashover ring is disposed on the bushing insert and when the bushing insert with the anti-flashover are mated with the cable connector. ---

Claim 34, should be deleted, in its entirety.

Signed and Sealed this

Fourth Day of March, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,213,799 B1
DATED : April 10, 2001
INVENTOR(S) : Roy E. Jazowski et al.

It is certified that error appears in the above-identified patent and that said Letters Patent is hereby corrected as shown below:

Column 7,
Line 45, cancel beginning with "2. An anti-flashover ring for facilitating" to and including "and the bushing port." in column 10, line 48, and insert the following claims:

- - 2. The method according to claim 1 wherein
the gaps provide continuous fluid communication between said outer atmosphere and the bushing port.

3. An anti-flashover ring for facilitating the mating of a bushing insert and a cable connector, comprising:

a ring-shaped body having inner and outer surfaces and first and second axial ends;
a shoulder wall extending radially inward from said inner surface; and a passageway extending along said outer surface and radially into said ring-shaped body;

whereby said passageway provides fluid communication between an outer atmosphere surrounding the bushing insert and the cable connector, when the anti-flashover ring is disposed on the bushing insert and when the bushing insert with the anti-flashover ring are mated with the cable connector.

4. An anti-flashover ring according to claim 3 wherein
said passageway extends from said first axial end to said second axial end.

5. An anti-flashover ring according to claim 3 wherein
said passageway has a pair of sidewalls connected by a bottom wall that forms part of said outer surface of said ring-shaped body.

6. An anti-flashover ring according to claim 5 wherein
said ring-shaped body has a central axis;
said pair of sidewalls are radially disposed relative to said central axis of said ring-shaped body; and
said bottom wall is concentric with said ring-shaped body.

7. An anti-flashover ring according to claim 3 wherein
said ring-shaped body has a plurality of passageways.

8. An anti-flashover ring according to claim 7 wherein
said plurality of passageways are evenly dispersed about said ring-shaped body.

9. An anti-flashover ring according to claim 3 wherein
said outer surface of said ring-shaped body has a color, said color is bright for indicating whether the bushi inserted is completely mated with the cable connector.

10. An anti-flashover ring according to claim 3 wherein
said ring-shaped body includes a means for engaging the bushing insert.

11. An anti-flashover ring according to claim 10 wherein
said means for engaging includes gripping feet extending from said inner surface of said ring-shaped body.

12. An anti-flashover ring according to claim 3 wherein
said anti-flashover ring is fabricated from a thermoplastic elastomer.

CERTIFICATE OF CORRECTION

PATENT NO. : 6,213,799 B1
DATED : April 10, 2001
INVENTOR(S) : Roy E. Jazowski et al.

It is certified that error appears in the above-identified patent and that said Letters Patent is hereby corrected as shown below:

13. An electrical connector, comprising:

a bushing insert having a non-conductive body with an inner bore, a conductive component disposed within said inner bore, a first portion, a second portion, and a shoulder portion linking said first and second portions;

an anti-flashover ring separably formed from said bushing insert and disposed on said shoulder portion having a ring-shaped body portion with an inner surface and an outer surface, first and second axial ends extending between said inner and outer surfaces, a shoulder wall extending radially from said inner surface, said shoulder wall abutting said shoulder portion of said non-conductive body, and a first passageway disposed along said outer surface and radially into said ring-shaped body portion; and a cable connector having a bushing port receiving said first portion and said shoulder portion of said bushing insert, said conductive component being electrically connected to said cable connector, said anti-flashover ring being disposed between said shoulder portion and said bushing port, and said first passageway of said anti-flashover ring providing fluid communication between an outer atmosphere surrounding said busing insert and said cable connector, and the bushing port.

14. An electrical connector according to claim 13 wherein
said first portion of said bushing insert has a frusto-conical shape forming a close fit with said bushing port; and
said second portion is received in an equipment bushing well of equipment.

15. An electrical connector according to claim 13 wherein
said ring-shaped body includes first and second axial ends extending between said inner and outer surfaces, said first passageway extending from said first axial end to said second axial end.

16. An electrical connector according to claim 13 wherein
said first passageway has a pair of sidewalls connected by a bottom wall.

17. An electrical connector according to claim 16 wherein
said ring-shaped body has a central axis;
said pair of sidewalls are radially disposed relative to said central axis of said ring-shaped body; and
said bottom wall is concentric with said ring-shaped body.

18. An electrical connector according to claim 13 wherein
said anti-flashover ring includes second and third passageways.

19. An electrical connector according to claim 18 wherein
said first, second, and third passageways are evenly dispersed.

20. An electrical connector according to claim 13 wherein
said bushing port includes a lip extending therefrom which covers said anti-flashover ring upon mating said bushing insert and said cable connector.

21. An electrical connector according to claim 20 wherein
said lip of said bushing port includes a terminal wall, said terminal wall is aligned and flush with said second end of said anti-flashover ring when said bushing insert is fully mated with said cable connector.

22. An electrical connector according to claim 21 wherein
said first passageway of said anti-flashover ring is open to said outer atmosphere when said bushing insert is fully mated with said cable connector.

UNITED STATES PATENT AND TRADEMARK OFFICE

CERTIFICATE OF CORRECTION

PATENT NO. : 6,213,799 B1
DATED : April 10, 2001
INVENTOR(S) : Roy E. Jazowski et al.

It is certified that error appears in the above-identified patent and that said Letters Patent is hereby corrected as shown below:

23. An electrical connector according to claim 22 wherein
said means for engaging includes gripping feet extending from said inner surface of said ring-shaped body.

24. An electrical connector according to claim 13 wherein
said means for engaging includes gripping feet extending from said inner surface of said ring-shaped body.

25. An electrical connector according to claim 13 wherein
said cable connector is an elbow connector.

26. An electrical connector, comprising:

a bushing insert having a non-conductive body with an inner bore, a conductive component disposed within said inner bore, a first portion, a second portion, and a shoulder portion linking said first and second portions;

an anti-flashover ring disposed on said bushing insert having a ring-shaped body portion with an inner surface and an outer surface, first and second axial ends extending between said inner and outer surfaces, and a first passageway disposed along said outer surface and radially into said ring-shaped body portion and extending from said first axial end to said second axial end; and a cable connector having a bushing port receiving said first portion and said shoulder portion of said bushing insert, and said anti-flashover ring, said bushing port having a lip with a terminal wall, said terminal wall being aligned and flush with said second axial end of said anti-flashover ring when said bushing insert is fully mated with said cable connector leaving said first passageway open to an outer atmosphere surrounding said bushing insert and said cable connector.

27. An electrical connector according to claim 26 wherein
said anti-flashover ring is disposed on said shoulder portion of said bushing insert, said anti-flashover ring being located between said shoulder portion and said bushing port when said bushing insert is mated with said cable connector.

28. An electrical connector according to claim 26 wherein
said conductive component is electrically connected to said cable connector when said bushing insert is mated with said busing port.

UNITED STATES PATENT AND TRADEMARK OFFICE

CERTIFICATE OF CORRECTION

PATENT NO. : 6,213,799 B1
DATED : April 10, 2001
INVENTOR(S) : Roy E. Jazowski et al.

It is certified that error appears in the above-identified patent and that said Letters Patent is hereby corrected as shown below:

29. An electrical connector according to claim 26 wherein
said first passageway provides continuous fluid communication between said bushing port and said outer atmosphere when both connecting and disconnecting said bushing insert and said bushing port of said cable connector preventing the reduction of pressure therebetween.

30. An electrical connector according to claim 26 wherein
said anti-flashover ring includes a shoulder wall extending radially inward from said inner surface of said ring-shaped body, said shoulder wall abutting said shoulder portion of said bushing insert.

31. An electrical connector according to claim 26 wherein
said anti-flashover ring is separable from said bushing insert.

32. An electrical connector according to claim 26 wherein
said anti-flashover ring includes a second passageway.

33. An electrical connector according to claim 26 wherein
said cable connector is an elbow connector. - -

Signed and Sealed this

Second Day of September, 2003

JAMES E. ROGAN
*Director of the United States Patent and Trademark Office*